US005387033A

United States Patent [19]

Domenig

[11] Patent Number: 5,387,033

[45] Date of Patent: Feb. 7, 1995

[54] LATERALLY ADJUSTABLE MOUNTING BRACKET FOR USE IN A DESK OR CABINET DRAWER AND WITH A DRAWER GUIDE HAVING A BENT TONGUE

[75] Inventor: Georg Domenig, Kernersville, N.C.

[73] Assignee: Grass America, Inc., Kernersville, N.C.

[21] Appl. No.: 21,519

[22] Filed: Feb. 23, 1993

[51] Int. Cl.[6] ..... A47B 88/00

[52] U.S. Cl. ..... 312/334.5; 312/330.1; 248/201

[58] Field of Search ..... 248/200, 201, 264, 265, 248/259, 316.7; 312/334.5, 330.1; 384/20-23

[56] References Cited

U.S. PATENT DOCUMENTS

| | | | |
|---|---|---|---|
| 3,377,115 | 4/1968 | Hansen et al. | 312/330.1 |
| 3,675,883 | 7/1972 | Holmes et al. | 312/334.5 X |
| 4,141,525 | 2/1979 | Miller | 312/334.5 X |
| 4,244,546 | 1/1981 | Mertes et al. | 312/334.5 X |
| 4,681,289 | 7/1987 | Gronlund et al. | 248/201 X |
| 4,792,195 | 12/1988 | Adriaansen | 248/201 X |
| 4,810,045 | 3/1989 | Lautenschlager | 312/334.5 X |
| 4,815,796 | 3/1989 | Röck et al. | 312/330.1 X |
| 5,257,861 | 11/1993 | Domenig et al. | 312/334.5 |
| 5,306,080 | 4/1994 | Luatenschlager | 312/334.5 |
| 5,310,255 | 5/1994 | Ranallo | 312/334.5 |

*Primary Examiner*—Karen J. Chotkowski

[57] ABSTRACT

A laterally adjustable mounting bracket for use on a desk or cabinet drawer and with a drawer guide having a tongue portion, the bracket including a base supporting a pair of opposing retaining flanges configured to cooperatively receive a drawer guide tongue portion for lateral adjustment of the drawer with respect to the desk or cabinet. An insert having a stop component limiting lateral movement of the drawer guide tongue portion and at least one support component is cooperatively received within at least one aperture in the base so that the support component extends through the base to support the base on the desk or cabinet.

29 Claims, 3 Drawing Sheets

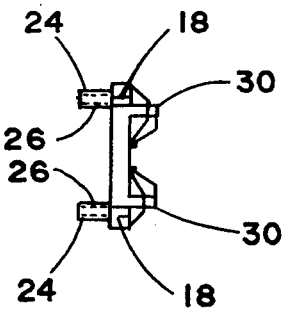
FIG. 3
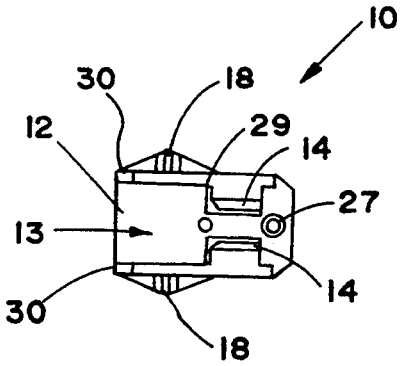
FIG. 1
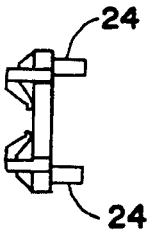
FIG. 4
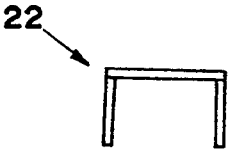
FIG. 5
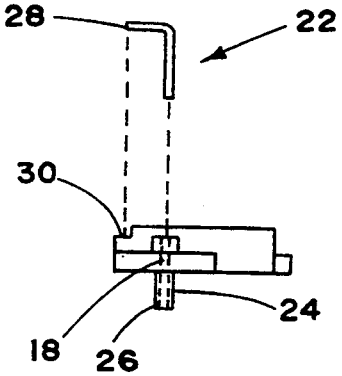
FIG. 2
FIG. 6
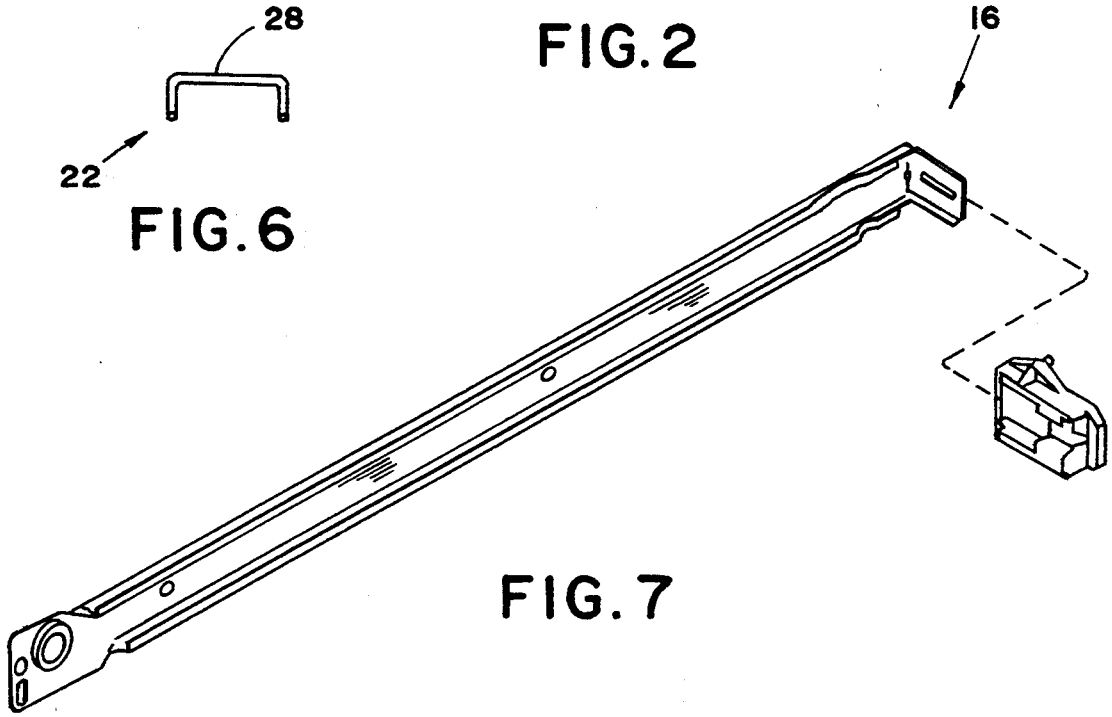
FIG. 7

LATERALLY ADJUSTABLE MOUNTING BRACKET FOR USE IN A DESK OR CABINET DRAWER AND WITH A DRAWER GUIDE HAVING A BENT TONGUE

BACKGROUND OF THE INVENTION

1. Field of the Invention

The present invention relates to desk or cabinet drawer mounting brackets and, more particularly, to a new and improved mounting bracket used in connection with a drawer guide having a tongue portion, the bracket having a base with opposing retaining flanges secured to the base to cooperatively receive the drawer guide tongue portion for lateral adjustment of the drawer with respect to the desk or cabinet.

2. Description of the Prior Art

Various types of mounting brackets for desk and cabinet drawers have been used in the furniture industry for many years. Generally such brackets are not precisely designed or engineered to achieve stability, long wear or efficient operation. They have adjustable elements usually formed directly in the bracket body making the bracket difficult to adjust, insufficient to achieve drawer stability with respect to the desk or cabinet, and quick to deteriorate. There is a current need to provide more precisely designed and manufactured mounting brackets which operate with greater efficiency and adjustability while retaining the cost associated with the design and manufacture of such devices within the same ranges as presently experienced with conventional brackets. The present invention addresses this need and interest.

SUMMARY OF THE INVENTION

The general purpose of the present invention, which will be described subsequently in greater detail, is to provide a new and improved adjustable mounting bracket to be used on a desk or cabinet drawer and with a drawer guide having a tongue portion that has all, and more, of the advantages of prior art brackets and none of the disadvantages.

To attain this purpose, representative embodiments of the present invention are illustrated in the drawings. The bracket of the present invention makes use of a base having spaced from each other a pair of retaining flanges which are configured to cooperatively receive the drawer guide tongue portion for lateral adjustment of the drawer with respect to its position within the desk or cabinet and which permit only lateral movement of the drawer guide tongue portion relative to the bracket. The base has at least one aperture which cooperatively receives an insert designed to carry a stop component and at least one support component. The support component extends through the aperture in the base to cooperatively support the bracket and drawer guide on the desk or cabinet. The stop component limits lateral movement of the drawer guide tongue portion relative to the desk or cabinet.

A drawer guide of the type with which the drawer guide mounting bracket of the present invention is intended for use is fastened by one or more fastening screws to the desk or cabinet at the end of the drawer guide opposite the drawer guide tongue portion. Accordingly, when the drawer guide is installed with its opposite end fastened, the drawer guide mounting bracket and received drawer guide tongue portion cannot pull away from the desk or cabinet. Thus it is not necessary that the drawer guide mounting bracket be fastened to the desk or cabinet, but only that the drawer guide mounting bracket be supported by the desk or cabinet.

In the bracket of the present invention the insert carries at least one support component which is received in the passage of a dowel extending from the back wall of the base and the dowel engages the desk or cabinet, the support component thus reinforcing the dowel. Additional support can be provided, with a second aperture formed in the base, by a second support component carried by the insert which is received in the passage of a second dowel extending from the back wall of the base. Alternatively, the support component can engage the desk or cabinet directly.

Moreover, to provide for lateral adjustment of the drawer with respect to the desk or cabinet, appropriate adjustable features of the bracket of the present invention limit lateral movement of the received drawer guide, drawer guide tongue portion and carded drawer. The retaining flanges partially retain the drawer guide tongue portion by frictional force. One or both of the retaining flanges may be configured as spring flanges, or the insert may be configured as a screw enabling releasable securement of the tongue member to the bracket base, to maintain the tongue portion in a fixed relationship with the bracket until a predetermined amount of force is exerted to readjust that relationship.

This outline focuses on the more important features of the invention in order that the detailed description which follows may be better understood and in order that the present contribution to the art may be better appreciated. There are, of course, additional features of the invention that will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and being carried out in various ways.

It is to be understood that the phraseology and terminology employed herein are for the purpose of description and are not to be regarded as limiting. Those skilled in the art will appreciate that the conception upon which this disclosure is based may readily be utilized as a basis for designing of the structures, method and systems for carrying out the several purposes of the present invention. The claims are regarded as including such equivalent constructions so long as they do not depart from the spirit and scope of the present invention.

From the foregoing summary, it is apparent that an object of the present invention is to provide a new and improved adjustable mounting bracket for a desk or cabinet drawer and with a drawer guide having a tongue portion which has all of the advantages, and more, of prior art brackets and none of the disadvantages.

It is another object of the present invention to provide a new and improved design of the type described that is more reliable and functional than those presently available.

Yet another object of the present invention is to provide a mounting bracket of the type described that enables repeated preselected lateral adjustments to be made to the mounted drawer relative to the desk or cabinet and yet operate reliably and efficiently thereafter.

Still another object of the present invention is to provide a bracket of the type described utilizing an insert that functions as a stop limiting lateral movement of the drawer guide tongue portion and as a support to maintain the bracket in a fixed relationship with the desk or cabinet.

These, together with other objects of the present invention, along with the various features of novelty which characterize the invention, are pointed out with particularity in the claims annexed to and forming a part of this disclosure. For a better understanding of the invention, its operating advantages, and the specific objects attained by its uses, reference should be made to the accompanying drawings in which like characters of reference designate like parts throughout the several views.

BRIEF DESCRIPTION OF THE DRAWINGS

The invention will be better understood and objects other than those set forth above will become apparent when consideration is given to the following detailed description. Such description makes reference to the annexed drawings wherein:

FIG. 1 is a plan view of the adjustable mounting bracket comprising the present invention;

FIG. 2 is a side elevational view of the bracket shown in FIG. 1;

FIG. 3 is a front elevational view of the bracket shown in FIGS. 1 and 2;

FIG. 4 is a rear elevational view of the bracket shown in FIGS. 1, 2 and 3;

FIG. 5 is a front elevational view of the insert forming a part of FIG. 2;

FIG. 6 is a top elevational view of the insert shown in FIG. 5;

FIG. 7 is a perspective and fragmentary view of the drawer guide having a bent tongue portion that is cooperatively and adjustably received by the bracket shown in FIGS. 1, 2, 3 and 4;

DESCRIPTION OF THE PREFERRED EMBODIMENT

Figure 11:
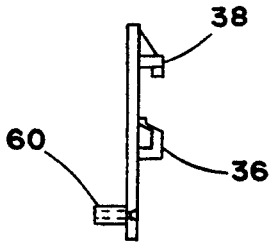
FIG. 11 is a front elevational view of the bracket shown in FIGS. 8, 9 and 10.
Figure 8:
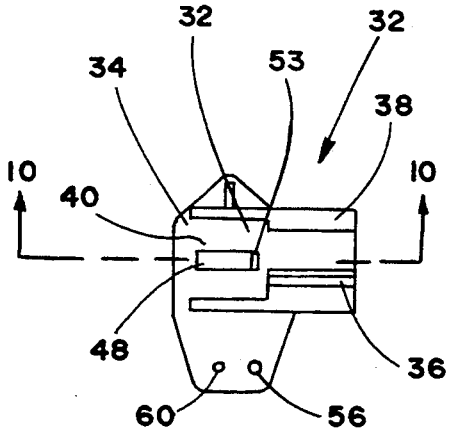
FIG. 8 is a plan view of an alternate embodiment of the adjustable mounting bracket comprising the present invention.
Figure 12:
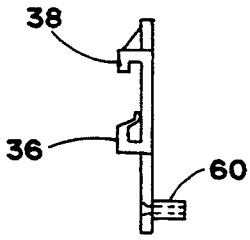
FIG. 12 is a rear elevational view of the bracket shown in FIGS. 8, 9, 10 and 11.
Figure 9:
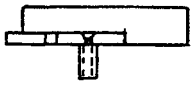
FIG. 9 is a first side elevational view of the bracket shown in FIG. 8.
Figure 13:
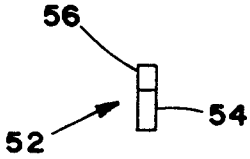
FIG. 13 is a rear elevational view of the insert forming a part of FIG. 10.
Figure 10:
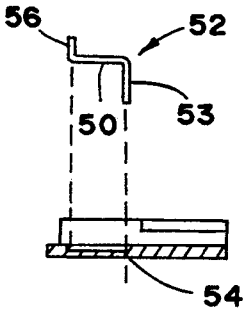
FIG. 10 is a second side elevational view of the bracket shown in FIGS. 8 and 9.

Referring now to the drawings, and specifically to FIGS. 1–7, an adjustable mounting bracket shown generally as 10 has a base 12 and opposing spring flanges 14 flexibly secured to base 12 and configured to cooperatively receive (see arrow 13) the drawer guide tongue portion shown generally as 16 in FIG. 7. Tongue portion 16 is positioned against base 12 and moved into engagement under spring flanges 14. Spring flanges 14, which partially encircle tongue portion 16, provide a retaining force against tongue portion 16 when it is positioned between spring flanges 14.

Bracket base 12 has apertures 18 extending through base 12 to receive support components or legs 20 of an insert shown generally as 22, and dowels 24 extending from the back wall of base 12 are provided with passages 26 to receive support components or legs 20 of insert 22. Dowels 24 engage bore holes formed in the back wall of a desk or cabinet drawer to maintain the bracket and its supported drawer guide and associated tongue portion with respect thereto, and support components or legs 20 of insert 22 provide reinforcement of dowels 24.

A generally U-shaped stop component 28 of insert 22 is dimensioned to enable insertion of tongue portion 16 and serves to prevent withdrawal of tongue 16 once it has been adjustably engaged with bracket 10. A pair of recesses 30 provided on base 12 retain stop component 28 when legs 20 of insert 22 are received in apertures 18 and passages 26.

Under normal conditions, with the carried drawer guide fastened to the desk or cabinet at its end opposite the drawer guide tongue portion, the installed drawer guide mounting bracket and received drawer guide tongue portion cannot pull away from the desk or cabinet to disengage dowels 24 from the back wall of the desk or cabinet. While support for maintaining the bracket and carried drawer guide tongue portion is provided by support components 20 received in passages 26 of dowels 24, under certain conditions, for example warpage of the desk or cabinet or for shipping or storage considerations, it may be desirable to fasten the bracket to the desk or cabinet. In that event, one or more holes 27, 29 formed in base 12 may receive a fastening screw to be inserted through base 12 and into the desk or cabinet.

The device forming the present invention is designed primarily for use with a double-captive drawer guide system which includes a drawer guide having a top flange which curves around the top of the roller of the drawer side rail and a drawer side rail having a top flange which curves around the top of the roller of the drawer guide. The drawer side rail roller cannot be disengaged from the guide rail, and the guide rail roller cannot be disengaged from the drawer side rail by lateral force applied to the drawer. Thus a lateral force applied to the installed drawer laterally repositions both drawer guides at the same time.

Figure 14:
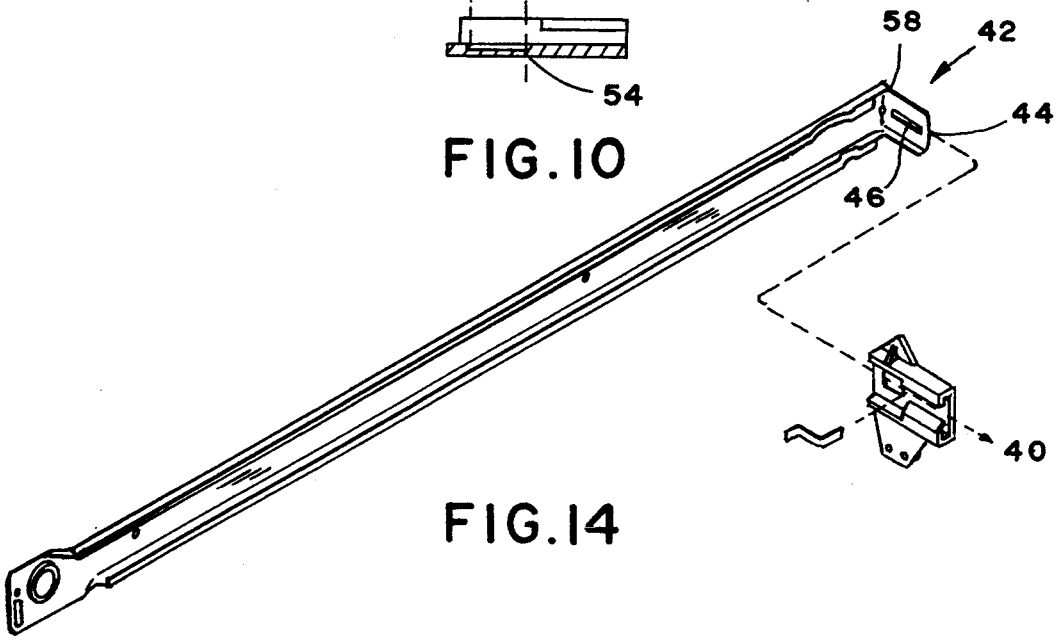
FIG. 14 is a perspective and fragmentary view of the drawer guide having a bent tongue portion that is cooperatively and adjustably affixed to the bracket illustrated in FIGS. 8, 9, 10, 11 and 12.
Figure 17:
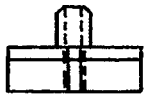
FIG. 17 is a plan view of the bracket shown in FIGS. 15 and 16.
Figure 15:
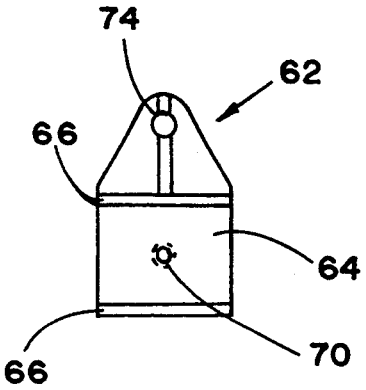
FIG. 15 is a front elevational view of a second alternate embodiment of the adjustable mounting bracket comprising the present invention.
Figure 16:
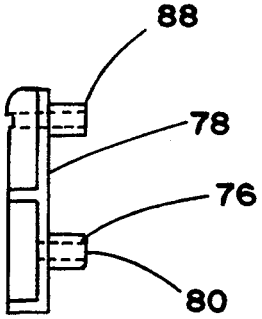
FIG. 16 is a side elevational view of the bracket shown in FIG. 15.
Figure 18:
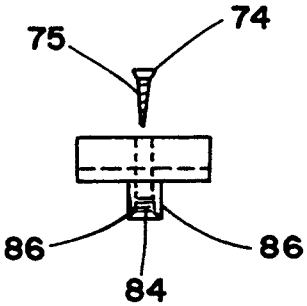
FIG. 18 is a bottom view of the bracket shown in FIGS. 15, 16 and 17.

Referring next to FIGS. 8–14, an alternate embodiment of an adjustable mounting bracket of the present invention shown generally as 32 has a base portion 34 supporting a spring flange 36 and a retaining flange 38 positioned parallel to and opposite each other to cooperatively receive (see arrow 40) the drawer guide tongue portion shown generally as 42 in FIG. 14. Tongue portion 42 has a leading edge 44 and a slotted opening 46 formed centrally therein. The spring and retaining flanges provide a retaining force against tongue portion 42 when it is positioned therebetween by at least partial encirclement.

Bracket base 34 has a recess 48 formed in the base 34 to receive the central portion 40 of an insert shown generally as 52. An aperture 54 extends through base 34 at one end of recess 48 to accommodate a support component 54 forming one leg portion of generally Z-shaped insert 52. Support component 54 engages the back wall of a desk or cabinet drawer to maintain the bracket and its supported drawer guide and associated tongue portion with respect thereto.

A stop component 56 forms the second leg portion of insert 52 and serves to prevent withdrawal of tongue 42 once it has been adjustably engaged with bracket 32. The stop is dimensioned to enable insertion of tongue 42 into bracket 32. Once tongue 42 is positioned in a proper relationship with respect to bracket 32, stop component 56 springs engages bent edge 58 of tongue 42 and prevents its removal.

While support for maintaining the bracket and the carded drawer guide tongue portion is provided by support component 54, additional support may be provided by fashioning at least one dowel 60 in the base as shown in FIG. 11 to extend from the bracket back wall and engage the desk or cabinet. Under normal conditions, it is not necessary to fasten the bracket to the desk or cabinet. In the event it is desired to fasten the bracket to the desk or cabinet because of shipping or storing considerations or to avoid possible problems caused by warpage of the desk or cabinet, a hole 56 formed in base 34 may receive a fastening screw to be inserted through base 34 and into the desk or cabinet.

Figure 19:
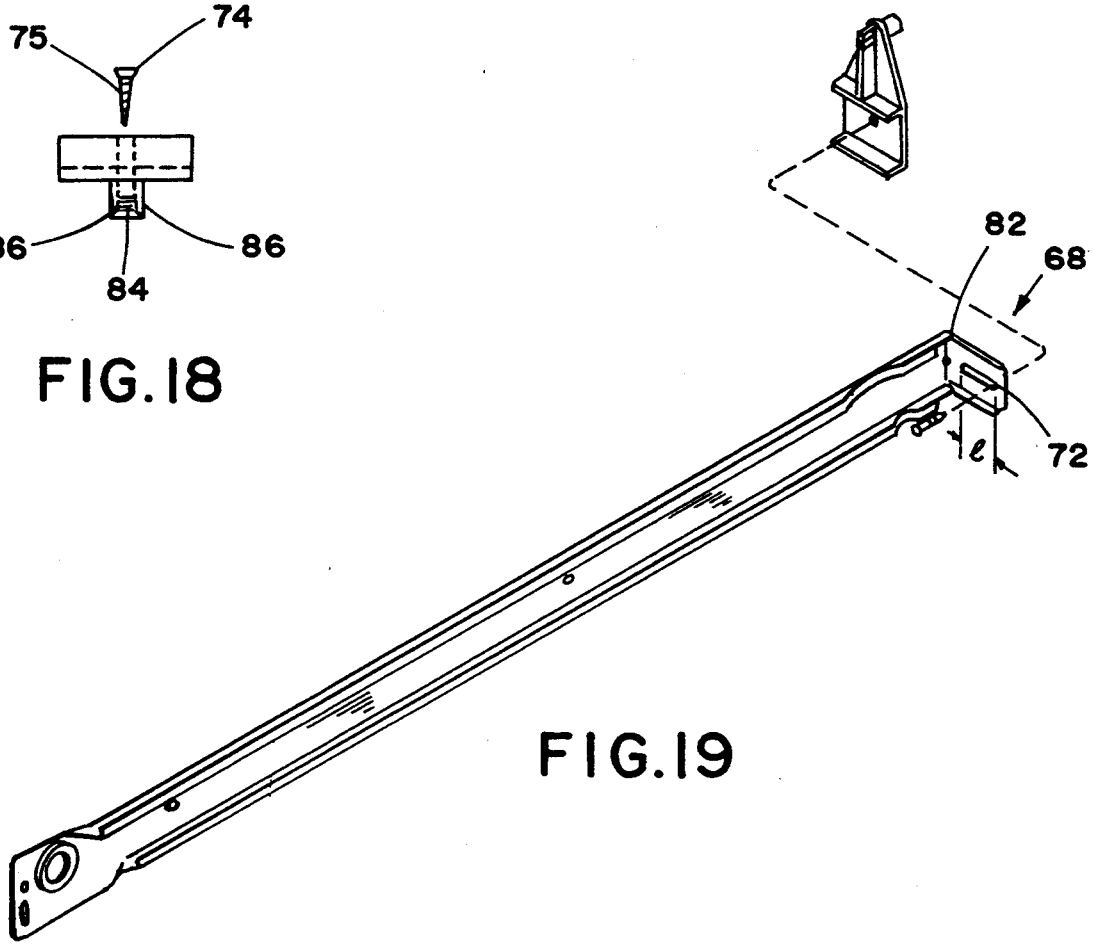
FIG. 19 is a perspective and fragmentary view of the drawer guide having a tongue portion that is cooperatively and adjustably received by the bracket shown in FIGS. 15, 16, 17 and 18.

Referring further to FIGS. 15–19, another alternate embodiment of the laterally adjustable mounting bracket of the present invention shown generally as 62 has a base 64 carrying opposing retaining flanges 66, which cooperatively receive drawer guide tongue portion shown generally as 68 in FIG. 19. An aperture 70 is formed in base 64 and coincides with slotted hole 72 formed in tongue portion 68. A threaded member, usually a conventional screw 74, is dimensioned to extend through tongue member slotted hole 72 and aperture 70 of base 64 into a dowel 76 affixed to the rear wall 78 of base 64 containing a passage 80 coinciding with aperture 70.

Screw 74 serves to adjustably secure bracket 62 to tongue portion 68 at a predetermined location anywhere within the length 1 of slotted hole 22, the adjustment prior to tightening screw 74 being manually accomplished by moving tongue member 68 with respect to bracket 62 and allowing tongue body 82 to frictionally slide along base 64 between flanges 66. When screw 74 is received in aperture 70, shaft 75 of screw 74 serves as a stop component limiting lateral movement of drawer guide tongue portion 68 within such length 1 of slotted hole 22.

Dowel 76 has a diametrical slot 84 formed therein which engages passage 80. When screw 74 is tightened in dowel 76, the ears 86, defined when slot 84 is formed are urged apart to form a locking engagement with the mounting hole in the cabinet or desk wall into which dowel 76 is inserted.

A second dowel 88 is provided on the rear wall of base 64 and gives additional support to the mounting bracket when it is secured to the desk or cabinet wall. Further, an additional screw may be inserted through dowel 48 which can be formed in the same manner as dowel 76 to provide even greater support and securement to the desk or cabinet wall.

Obviously any number of materials may be used to form the bracket and its components described herein, and exceptional success has been experienced by the use of semi-rigid plastic materials for the base and dowel or dowels. The firmest control and support is achieved by the use of a metal insert, although other materials may be utilized when lesser support is necessary.

With respect to the descriptions set forth above, optimum dimensional relationship for the parts of the invention (to include variations in size, materials, shape, form, function and manner of operation, assembly and use) are deemed readily apparent and obvious to those skilled in the art, and all equivalent relation-ships to those illustrated in the drawings and described in the specification are intended to be encompassed herein. The foregoing is considered as illustrative only of the principals of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A laterally adjustable mounting bracket for use in a desk or cabinet drawer and with a drawer guide having a tongue portion, the bracket comprising: a base having portions defining an aperture; opposing retaining flanges secured to the base and cooperatively receiving the drawer guide tongue portion for lateral adjustment; an insert receivable by the aperture for engaging the drawer guide tongue portion limiting the lateral movement of the drawer guide and carried drawer; and means supporting said base on the desk or cabinet.

2. The bracket as claimed in claim 1 further comprising a stop component carried by said insert limiting lateral movement of said drawer guide tongue portion when said insert is received by said aperture.

3. The bracket as claimed in claim 2 wherein said base has a front and a back wall, and said aperture extends through said base from said front wall to said back wall for receiving said insert.

4. The bracket as claimed in claim 3 wherein said supporting means comprises at least one support component carried by said insert for supporting said base on said desk or cabinet when said insert is received by said aperture.

5. The bracket as claimed in claim 4 wherein said retaining flanges at least partially encircle said drawer guide tongue portion.

6. The bracket as claimed in claim 5 wherein as least one of said retaining flanges is a spring flange flexibly secured to said base.

7. The bracket as claimed in claim 6 wherein said supporting means further comprises a pair of dowels extending from said back wall for engaging the desk or cabinet.

8. The bracket as claimed in claim 7 wherein said base has a portion defining a second aperture extending through said base from said front wall to said back wall; and further comprising a pair of support components carried by said insert, each of said dowels having a passage in communication with one of said apertures for receiving one of said support components; and said supporting means further comprises said support components receivable in said passages of said dowels and reinforcing said dowels.

9. The bracket as claimed in claim 8 wherein both of said retaining flanges are spring flanges flexibly secured to said base.

10. The bracket as claimed in claim 9 wherein said insert includes a generally U-shaped portion interconnecting a pair of leg portions, and wherein said stop component comprises said U-shaped portion for engaging and limiting lateral movement of the drawer guide tongue portion, and said support components comprise said leg portions receivable in said dowel passages and reinforcing said dowels.

11. The bracket as claimed in claim 10 wherein said front wall includes portions defining a pair of recesses for retaining said insert.

12. The bracket as claimed in claim 11 wherein said base and dowels are made of a semi-rigid plastic material.

13. The bracket as claimed in claim 12 wherein said insert is made of metal.

14. The bracket as claimed in claim 13 wherein the drawer tongue portion is curved.

15. The bracket as claimed in claim 6 wherein said support component is receivable in said aperture for engaging the desk or cabinet.

16. The bracket as claimed in claim 15 wherein said insert is generally Z-shaped and includes leg portions, and wherein said stop component comprises one of said leg portions for engaging and limiting lateral movement of the drawer guide tongue portion, and said support component comprises another of said leg portions receivable by said aperture for engaging the desk or cabinet.

17. The bracket as claimed in claim 16 wherein said supporting means further comprises as least one dowel extending from said back wall for engaging the desk or cabinet.

18. The bracket as claimed in claim 17 wherein said front wall includes a portion defining at least one recess for retaining said insert.

19. The bracket as claimed in claim 18 wherein said base and dowel are made of a semi-rigid plastic material.

20. The bracket as claimed in claim 19 wherein said insert is made of metal.

21. The bracket as claimed in claim 20 wherein the drawer guide tongue portion is curved.

22. The bracket as claimed in claim 4 wherein said supporting means further comprises at least one dowel extending from said back wall for engaging the desk or cabinet.

23. The bracket as claimed in claim 22 wherein said aperture further comprises a passage for receiving a screw, said insert comprises a screw having a head and a shaft receivable in said passage, and said stop component comprises said screw shaft receivable in said passage of said aperture for engaging and limiting lateral movement of said drawer guide tongue portion.

24. The bracket as claimed in claim 23 wherein said dowel has a portion defining a passage for receiving said screw in communication with said passage of said aperture, and said support component comprises said screw shaft receivable in said passage of said dowel and reinforcing said dowel.

25. The bracket as claimed in claim 24 wherein said dowel is deformable, and said passage of said dowel is dimensioned to expand said dowel when said screw is received in said passage of said dowel.

26. The bracket as claimed in claim 25 wherein said screw is metal.

27. The bracket as claimed in claim 26 wherein said supporting means further comprises a second dowel extending from said back wall for engaging the desk or cabinet.

28. The bracket as claimed in claim 27 wherein said base and dowels are made of a semi-rigid plastic material.

29. The bracket as claimed in claim 28 wherein the drawer guide tongue portion is curved.

* * * * *